US005653525A

United States Patent [19]

Park

[11] Patent Number: 5,653,525

[45] Date of Patent: Aug. 5, 1997

[54] POCKET TOOL

[76] Inventor: Kyunghan Park, (26/7) 339-24, Ungam-dong, Unpyong-gu, Seoul, Rep. of Korea

[21] Appl. No.: 419,443

[22] Filed: Apr. 10, 1995

[30] Foreign Application Priority Data

Apr. 11, 1994 [KR] Rep. of Korea ..... 94-7467

[51] Int. Cl.[6] ..... B25B 23/18

[52] U.S. Cl. ..... 362/119; 362/120; 431/253; 431/129; 7/118

[58] Field of Search ..... 431/253, 129, 431/144, 153; 206/223, 373, 374; 7/118, 119; 362/119, 120, 253

[56] References Cited

U.S. PATENT DOCUMENTS

| | | | |
|---|---|---|---|
| 619,765 | 2/1899 | Layes | 431/253 X |
| 2,496,840 | 2/1950 | Alexander | 431/253 X |
| 2,828,855 | 4/1958 | Mosch | 431/253 X |
| 4,364,104 | 12/1982 | Holahan et al. | 362/119 X |
| 5,442,529 | 8/1995 | Hoover | 362/119 |

*Primary Examiner*—Larry Jones
*Attorney, Agent, or Firm*—Whitham, Curtis, Whitham & McGinn

[57] ABSTRACT

A pocket tool is disclosed. A mount panel of the pocket tool has a hollow coupling projection for pivoting varieties of tool members as well as for fixing the mount panel to the other mount panel. A turn-up scissors are interposed between the opposed mount panels and coupled to the hollow coupling projection. The scissors have a return spring at the cross for automatically opening the scissors, the return spring being placed in a space defined by slots formed about cross coupling holes and fitted over a cross coupling pin at the cross of the scissors such that the return spring is out of view and improves the appearance of the pocket tool. The scissors are also free from any trouble and achieve the recent trend of compactness.

5 Claims, 4 Drawing Sheets

POCKET TOOL

BACKGROUND OF THE INVENTION

1. Description of the Invention

The present invention relates in general to a pocket tool provided with varieties of fold-up tool members, such as knifes, scissors and cosmetic file, and suitable for collaterally use as a key holder and, more particularly, to a structural improvement in such a pocket tool for simplifying the production procedure, reducing the cost, and improving the appearance of the pocket tool and for mounting a flashlight or a lighter to the pocket tool.

2. Description of the Prior Art

With reference to FIGS. 12 and 12A, there is shown in an exploded perspective view and in a sectioned view a typical pocket tool with a fold-up tool member. In the pocket tool, the fold-up tool member 22 is interposed between and pivoted to opposed mount panels 21 and 21' such that the tool member 22 can be opened and closed relative to a panel housing, comprising the panels 21 and 21', as desired. In order to integrate the panels 21 and 21' into the panel housing as well as to pivot the tool member 22 to the panel housing, the pocket tool uses pins or rivets 23. The typical pocket tool also preferably include scissors 24 which are shown in FIG. 11. As shown in FIG. 11, the handles of the scissors 24 are biased by a return spring or a plate spring 25 for automatically opening the scissors 24, one end of the spring 25 being fixed to an appropriate portion 26 of one of the handles but the other end of the spring 25 being separated from the other handle. When the handles of the scissors 24 are manually compressed toward each other, the spring 25 will come into contact with and slide on the other handle of the scissors 24 and bias the other handle such that the handles can automatically return to their opened position when the compressing force is removed from the handles.

However, it has been noted that the typical pocket tool has a problem that use of the pins or rivets 23 complicates the production procedure of the pocket tool and increases the cost of the pocket tool. The handles of the scissors 24 of the pocket tool are biased by the plate spring 25, one end 26 of the spring 25 being fixed to one of the handles but the other end of the spring 25 being separated from the other handle so that the spring 25 will come into contact with and slide on the other handle of the scissors 24 and bias the other handle when the handles of the scissors 24 are manually compressed toward each other. However, the plate spring 25 is open to the view so that the spring 25 spoils the beauty of the pocket tool. In addition, as the other end of the plate spring 25 is separated from the other handle of the scissors 24, the spring 25 may fail in aligning with the other handle of the scissors 24 and achieve no biasing action for the other handle when there is a positional displacement of the spring 25.

SUMMARY OF THE INVENTION

It is, therefore, an object of the present invention to provide a pocket tool in which the above problems can be overcome and which includes a mount panel with a hollow coupling projection for pivoting varieties of tool members as well as for fixing the mount panel to the other mount panel and thereby reducing the consumption of the material of pocket tool and reducing the cost of the pocket tool, and which includes turn-up scissors interposed between the opposed mount panels and coupled to the hollow coupling projection, which scissors have a return spring at the cross for automatically opening the scissors, the return spring being placed in a space defined by slots formed about cross coupling holes and fitted over a cross coupling pin at the cross of the scissors such that the return spring is out of view and improves the appearance of the pocket tool, and which scissors are also free from any trouble due to sudden separation of the return spring and achieve the recent trend of compactness.

In order to accomplish the above object, the present invention provides a pocket tool comprising: opposed mount panels fixed to each other with turn-up scissors interposed therebetween, one of the panels having a hollow coupling projection, while the other panel having a coupling hole, the hollow projection being fitted into the coupling hole with the scissors coupled to the projection and thereby fixing the panels to each other; and the turn-up scissors interposed between the panels and coupled to the hollow coupling projection, the scissors having a return spring at the cross for automatically opening the scissors, the return spring being placed in a space defined by slots formed about cross coupling holes and fitted over a cross coupling pin at the cross of the scissors such that the return spring is out of view.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figures 1, 1A:
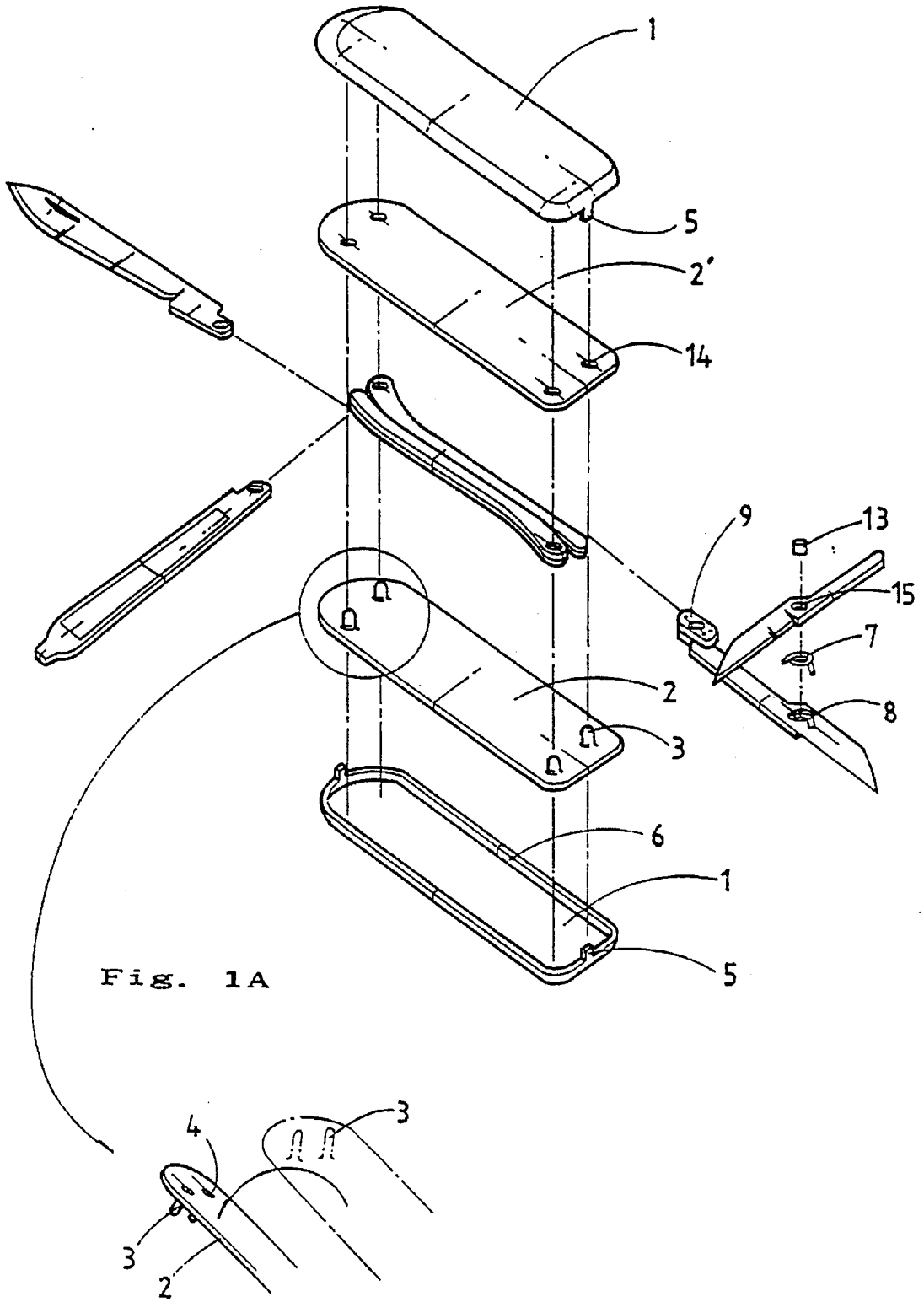
FIG. 1 is an exploded perspective view of a pocket tool of the present invention.
FIG. 1A is a perspective view of a bottom mount panel turned over.
Figure 2:
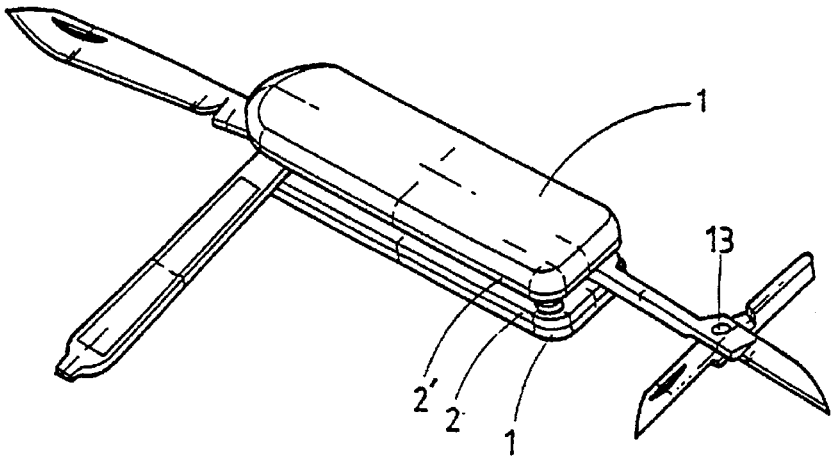
FIG. 2 is a perspective view of the pocket tool of FIG. 1 with opened tool members and in assembled state.
Figure 3:
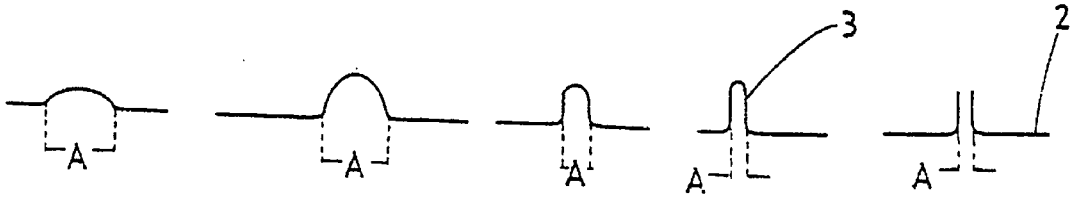
FIG. 3 is a view showing the process for forming a hollow coupling projection on the mount panel of the pocket tool of the present invention.
Figure 4:
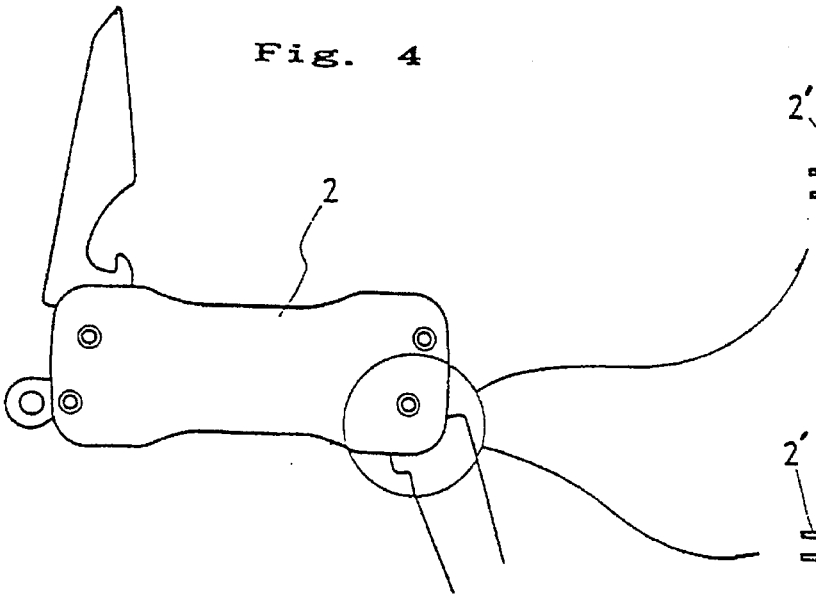
FIG. 4 is a front view of the pocket tool of FIG. 1 with opened tool members.

With reference to FIGS. 1 to 10, there is shown a pocket tool of the present invention. In the pocket tool of the invention, varieties of tool members, such as knifes, scissors and cosmetic file, are interposed between and pivoted to opposed mount panels of a predetermined thickness, which panels in turn are covered with their caps, in the same manner as the typical pocket tool. One panel 2 is provided with hollow coupling projections 3, which projections 3 are formed by progressively pressing the panel 2 as shown in FIG. 3 so that the projections 3 also define fitting holes 4 therein, respectively. The tool members are movably fitted over the projections 3 of the one panel 2 prior to fixing the other panel 2', having coupling holes 14 to engage with the projections 3, to the one panel 2. The outside surfaces of the fixed mount panels 2 and 2'are, thereafter, covered with their caps 1. The caps 1 have steps 6 for receiving the predetermined thickness of panels 2 and 2' therein. The opposed ends of each cap 1 are provided with protrusions 5 for letting the caps 1 remain in the place relative to the panels 2 and 2'.

The scissors of the pocket tool are disposed between the panels 2 and 2' and pivoted to one of the hollow coupling projections 3 of the panel 2. The two scissor pieces of the scissors cross each other and are movably coupled to each other at the cross by a cross coupling pin 13, which pin 13 are commonly fitted into cross coupling holes 15 of the scissor pieces. The pieces of the scissors are provided with slots 8 on their inside surfaces about the coupling holes 15 so that the slots 8 define a space about the holes 15 when the pieces cross each other and are assembled into the scissors. A coiled torsion spring 7 as a return spring is placed in the space defined by the slots 8 of the scissors such that the coupling pin 13 penetrates the spring 7 when assembling the pieces into the scissors by the coupling pin 13. As the coiled torsion spring 7 is placed in the space defined by the slots 8, the torsion spring 7 is out of sight.

Figure 5:
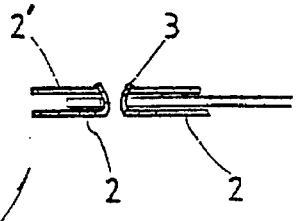
FIG. 5 is a sectioned view of the pocket tool of the invention, showing an embodiment of fixing of the mount panels.
Figure 6:
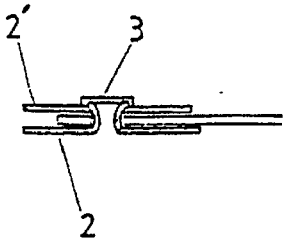
FIG. 6 is a sectioned view of the pocket tool of the invention, showing another embodiment of fixing of the mount panels.
Figure 7:
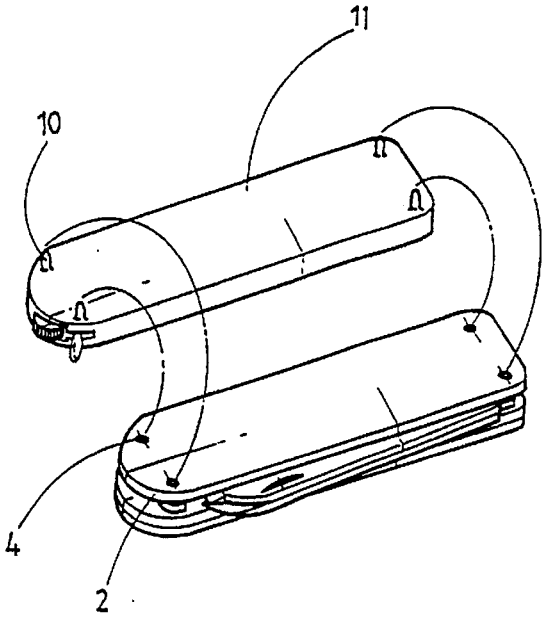
FIG. 7 is an exploded perspective view of the pocket tool provided with a lighter in accordance with an embodiment of the present invention.
Figure 8:
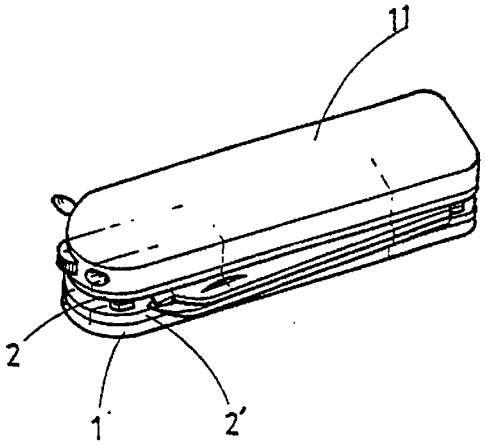
FIG. 8 is a perspective view of the pocket tool provided with the lighter of FIG. 7.
Figure 9:
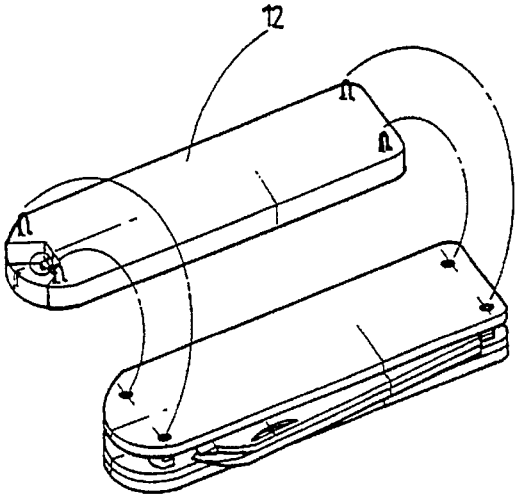
FIG. 9 is an exploded perspective view of the pocket tool provided with a flashlight in accordance with another embodiment of the present invention.
Figure 10:
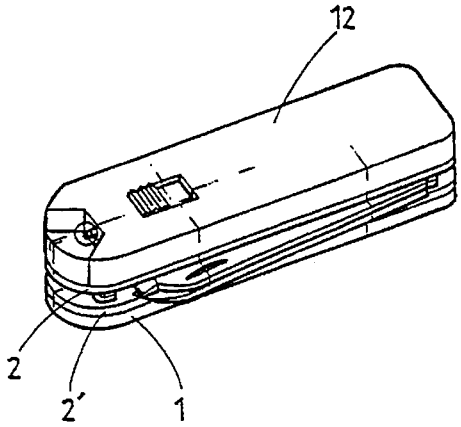
FIG. 10 is a perspective view of the pocket tool provided with the flashlight of FIG. 9.
Figure 11:
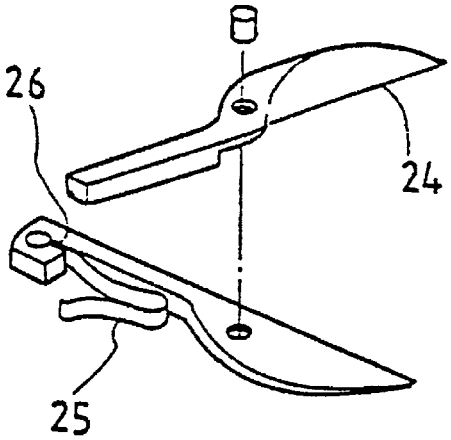
FIG. 11 is an exploded perspective view of a typical scissors with a plate spring as a return spring.
Figure 12:
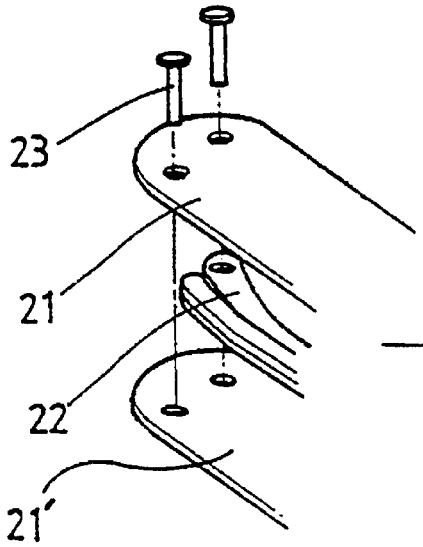
FIG. 12 is an exploded perspective view of a typical pocket tool.
Figure 12A:
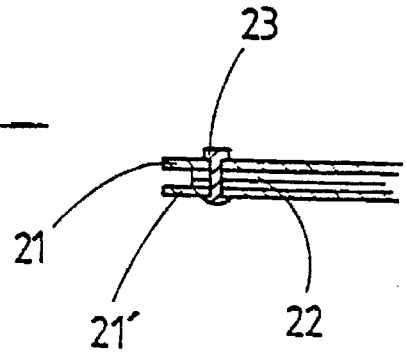
FIG. 12A is a sectioned view of the typical pocket tool, showing a structure for pivoting a tool member to the pocket tool.

In order to provide reliable snap motion for the scissors when taking the scissors out of and into the panel housing of the pocket tool, a snap plate 9 is provided in the coupling end of the scissors, the scissors being coupled to the housing at the coupling end. In the present invention, fixing of the panels 2 and 2' may be achieved by fitting the projections 3 of the panel 2 into the holes 14 of the panel 2' and by slitting and diffusing the tops of the projections 3 as shown in FIG. 5. Alternatively, fixing of the panels 2 and 2' may be achieved by fitting the projections 3 of the panel 2 into the holes 14 of the panel 2' and by pressing down the tops of the projections 3 as shown in FIG. 6.

In accordance with the present invention, either a lighter 11 or a flashlight 12 may be mounted to the pocket tool as shown in FIGS. 7 to 10. In this case, the lighter 11 or the flashlight 12 is provided with fitting projections 10 which will be fitted into the fitting holes 4 of the coupling projections 3 of the panel 2. When the panel 2 is covered with either the lighter 11 or the flashlight 12 as described above, only the panel 2' is covered with the cap 1.

When covering the caps 1 on the mount panels 2 and 2', the mount panels 2 and 2' are seated on the steps 6 of their associated caps 1 such that the inside surfaces of the panels 2 and 2' are leveled with the edges of the caps 1 respectively. Thereafter, the projections 5 of the caps 1 are bent upon the panels 2 and 2' so that the panels 2 and 2' remain in the place in the caps 1.

In the present invention, the panel 2 is provided with the hollow coupling projections 3, which projections 3 are integrally formed with the panel 2 by progressively pressing the panel 2 as shown in FIG. 3 and commonly used for fixing the panels 2 and 2' to each other and pivoting the tool members to the pocket tool. The pocket tool of the invention uses neither pin 23 nor rivet for fixing the panels 2 and 2' and pivoting the tool members differently from the typical pocket tool. With the integrated coupling projections 3, the instant pocket tool reduces the material and the cost, and improves the coupling force of the tool members as well as the fixing force of the panels 2 and 2'.

In the scissors interposed between the panels 2 and 2' and pivoted to one of the hollow coupling projections 3 of the panel 2, the two scissor pieces of the scissors are provided with the slots 8 on their inside surfaces about the coupling holes 15 and the torsion spring 7 having the shape of α or υ is placed in the space of the slots 8 such that the torsion spring 7 is out of sight.

When assembling the scissors, the coupling pin 13 penetrates the spring 7 of the shape of α or υ as the spring 7 is placed in the space of the slots 8.

In the pocket tool of the invention, the return spring 7 is out of sight even when the scissors are opened so that the scissors improve the appearance. The spring 7 is also tightly placed in the space of the slots 8 and receives the coupling pin 13 so that the scissors achieve the reliable scissoring action. As there is no sliding structure in the return spring 7 of the scissors in contrast with the typical scissors 24 having the plate spring 25, the scissors of this invention achieves the recent trend of compactness. Furthermore, the pocket tool of this invention may be provided with the lighter 11 or the flashlight 12 by fitting the fitting projections 10 of the lighter or of the flashlight into the fitting holes 4 of the panel 2 so that the use of the pocket tool of this invention can be diversified. Of course, the panel 2 will be covered with the cap 1 when the panel 2 is provided with neither the lighter 11 nor the flashlight 12.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A pocket tool comprising:

opposed mount panels fixed to each other with turn-up scissors interposed therebetween, one of said panels having a hollow coupling projection, the other panel having a coupling hole, said hollow projection being fitted into the coupling hole with the scissors coupled to the projection and thereby fixing the panels to each other; and the turn-up scissors interposed between the panels and coupled to the hollow coupling projection having a return spring at the cross for automatically opening the scissors, said return spring being placed in a space defined by slots formed about cross coupling holes and fitted over a cross coupling pin at the cross of the scissors such that the return spring is out of view.

2. The pocket tool according to claim 1, further comprising a lighter mounted to the outer surface of the one panel provided with the hollow coupling projections by fitting a plurality of projections of the lighter into their associated fitting holes defined in said hollow coupling projections respectively.

3. The pocket tool according to claim 1, further comprising a flashlight mounted to the outer surface of one of said panels by fitting a plurality of projections provided on a surface of said flashlight into holes in said one panel defined by said hollow coupling projections.

4. The pocket tool according to claim 2, further comprising a flashlight mounted to the outer surface of one of said panels by fitting a plurality of projections provided on a surface of said flashlight into holes in said one panel defined by said hollow coupling projections.

5. A pocket tool comprising:

opposed mount panels fixed to each other with a tool member interposed therebetween, one of said panels having a hollow coupling projection, the other panel having a coupling hole, said coupling projection being fitted into said hole with said tool member being coupled to said hollow coupling projection, thereby fixing the panels to each other; and at least one of a flashlight and a lighter mounted to the outer surface of one of said panels by fitting a plurality of projections provided on a surface of said flashlight into holes in said one panel defined by said hollow coupling projections.

* * * * *